US008875910B2

(12) United States Patent
Wurr et al.

(10) Patent No.: US 8,875,910 B2
(45) Date of Patent: Nov. 4, 2014

(54) ASSEMBLY KIT FOR BUILDING A RACK

(75) Inventors: Patrick Wurr, Mielkendorf (DE); Kay Muhlack, Molfsee (DE)

(73) Assignee: Muhlack Kiel GmbH, Kiel (DE)

( * ) Notice: Subject to any disclaimer, the term of this patent is extended or adjusted under 35 U.S.C. 154(b) by 0 days.

(21) Appl. No.: 13/700,372

(22) PCT Filed: May 12, 2011

(86) PCT No.: PCT/DE2011/001067

§ 371 (c)(1),
(2), (4) Date: Nov. 27, 2012

(87) PCT Pub. No.: WO2011/150910

PCT Pub. Date: Dec. 8, 2011

(65) Prior Publication Data

US 2013/0067734 A1 Mar. 21, 2013

(30) Foreign Application Priority Data

May 29, 2010 (DE) ..... 10 2010 021 991

(51) Int. Cl.

| | |
|---|---|
| ***A47B 47/00*** | (2006.01) |
| ***A47B 43/00*** | (2006.01) |
| ***A47B 57/00*** | (2006.01) |
| ***A47B 57/50*** | (2006.01) |
| ***A47B 55/00*** | (2006.01) |
| ***A47B 96/14*** | (2006.01) |

(52) U.S. Cl.

CPC ..... *A47B 55/00* (2013.01); *A47B 57/50* (2013.01); *A47B 96/1408* (2013.01)

USPC ..... 211/192; 211/187

(58) Field of Classification Search

CPC ..... A47B 57/402

USPC ..... 211/189, 190–192, 134, 186, 187, 103; 108/106, 107, 147.11, 147.12, 147.13, 108/147.15, 147.16, 155; 248/243

See application file for complete search history.

(56) References Cited

U.S. PATENT DOCUMENTS

| | | | | |
|---|---|---|---|---|
| 918,039 | A * | 4/1909 | Grundmann | 211/191 |
| 1,969,656 | A * | 8/1934 | Marlowe | 52/651.1 |
| 2,971,658 | A * | 2/1961 | D Altrui | 211/193 |

(Continued)

FOREIGN PATENT DOCUMENTS

| | | |
|---|---|---|
| FR | 2142683 | 2/1973 |
| GB | 1139008 | 1/1969 |
| JP | 51128115 | 10/1976 |

*Primary Examiner* — Joshua Rodden
*Assistant Examiner* — Kimberley S Wright
(74) *Attorney, Agent, or Firm* — Diederiks & Whitelaw, PLC

(57) ABSTRACT

An assembly kit for building a rack includes a plurality of longitudinal members to be arranged vertically, a plurality of cross members to be arranged horizontally, a plurality of node elements that connect the longitudinal members and cross members to each other, and a plurality of rails that accommodate rack bottoms, drawers, and the like. The longitudinal members are provided with holes used to hook in the rails on first lateral surfaces of the longitudinal members facing each other, wherein the holes are T-shaped and include breakouts adjacent to the first lateral surfaces. The rails are longer than the open distance of a front longitudinal member from a rear longitudinal member by the depth of the breakouts and are provided with U-shaped folded edges. The width of the vertically extending section of the T-shaped hole corresponds to the length of the free leg of the U-shaped folded edge.

8 Claims, 2 Drawing Sheets

(56) References Cited

U.S. PATENT DOCUMENTS

| | | | | | |
|---|---|---|---|---|---|
| 2,984,363 | A | * | 5/1961 | Lang et al. | 211/182 |
| 3,208,778 | A | * | 9/1965 | Gordon | 403/329 |
| 3,358,848 | A | * | 12/1967 | Johnsson | 211/190 |
| 3,465,895 | A | * | 9/1969 | Miller | 211/191 |
| 4,055,253 | A | * | 10/1977 | Oztekin | 211/189 |
| 4,074,812 | A | * | 2/1978 | Skubic et al. | 211/192 |
| 4,224,776 | A | * | 9/1980 | Hammerschlag | 52/645 |
| 4,390,103 | A | * | 6/1983 | Husband | 211/182 |
| 4,444,323 | A | * | 4/1984 | Travis | 211/193 |
| 4,693,383 | A | * | 9/1987 | Fenwick | 211/192 |
| 4,796,541 | A | * | 1/1989 | Halstrick | 108/107 |
| 5,211,502 | A | * | 5/1993 | Upham-Hill | 403/353 |
| 5,806,820 | A | * | 9/1998 | Simon | 248/243 |
| 7,165,360 | B2 | * | 1/2007 | Thompson | 52/36.1 |

* cited by examiner

ASSEMBLY KIT FOR BUILDING A RACK

CROSS-REFERENCE TO RELATED APPLICATIONS

This application represents a National Stage application of PCT/DE2011/001067 entitled "Assembly Kit for Building a Rack" filed May 12, 2011, pending.

BACKGROUND OF THE INVENTION

The invention relates to an assembly kit for building a rack, comprising a plurality of longitudinal members to be arranged vertically, a plurality of cross members to be arranged horizontally, a plurality of node elements that connect said longitudinal members and cross members to each other, and a plurality of rails that accommodate rack bottoms, drawers, and the like, wherein the longitudinal members are provided with holes used to hook in the rails on the first lateral surfaces of the longitudinal members facing each other.

Assembly kits for building a rack having a multitude of designs are known. In this context it is desirable that these racks can be assembled and taken apart in a simple manner, it being possible to introduce different inserts, in particular rack bottoms, drawers and the like, into the rack. In the process it is known to place rails in the rack that are received by holes in the lateral surfaces of the longitudinal members, the inserts being placed on the rails.

The invention is based on the object of creating such an assembly kit where the rails can be inserted into the longitudinal members in a simple manner without using a tool, but secured sufficiently.

SUMMARY OF THE INVENTION

According to the invention, the object is achieved in that the holes in the longitudinal members are T-shaped in the top view and the vertically extending section of the T-shaped holes forms breakouts in the lateral surfaces adjacent to the first lateral surfaces and the rails are longer than the open distance of a front longitudinal member from a rear longitudinal member by the depth of the breakouts and are provided with U-shaped folded edges, the open width of which corresponds to the sections remaining in the first lateral surface on both sides of the vertically extending part of the T-shaped holes, and the width of the vertically extending section of the T-shaped hole to the length of the free leg of the U-shaped folded edge.

The invention is explained below using a drawing, in which

Figure 1:
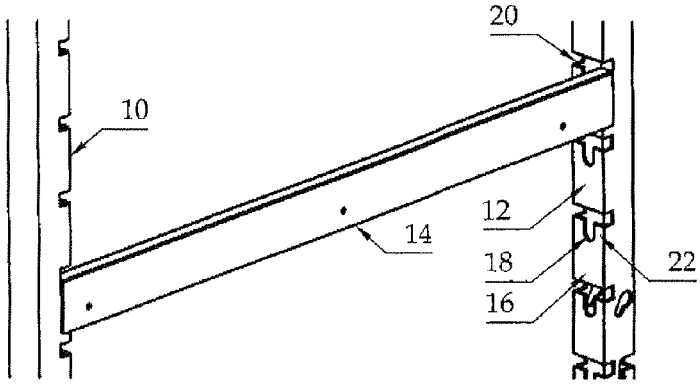
FIG. 1 shows a front and a rear longitudinal member between which a rail extends.
Figure 2:
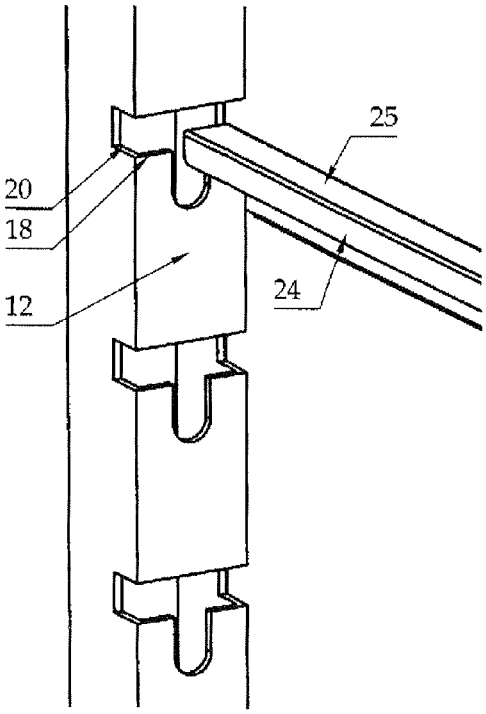
FIG. 2 shows an illustration of a first exemplary embodiment of the rail and FIG. 3 shows a second exemplary embodiment of the rail.

To create a rack using such a type of assembly kit, a front longitudinal member 10 and a rear longitudinal member 12 are erected and connected to each other using cross members (not shown) by means of node elements (not shown). In a first lateral surface 16, the longitudinal members 10, 12 are provided with holes 18 that are uniformly distributed across its length. In the top view, these holes are T-shaped, the vertically extending section forming holes 20 in the lateral surfaces adjacent to the first lateral surfaces 16.

DETAILED DESCRIPTION OF THE INVENTION

The rails 14 are longer by the depths of the breakouts 20 than the open distance of the front longitudinal member 10 from the rear longitudinal member 12 and are provided with U-shaped folded edges 24, 25, the open width 25 of which corresponds to the sections 22 remaining in the first lateral surface 10 on both sides of the vertically extending part of the T-shaped holes 18

The width of the vertically extending section of the T-shaped hole 18 corresponds to the length of the free leg 24 of the U-shaped folded edge 24, 25.

Figure 3:
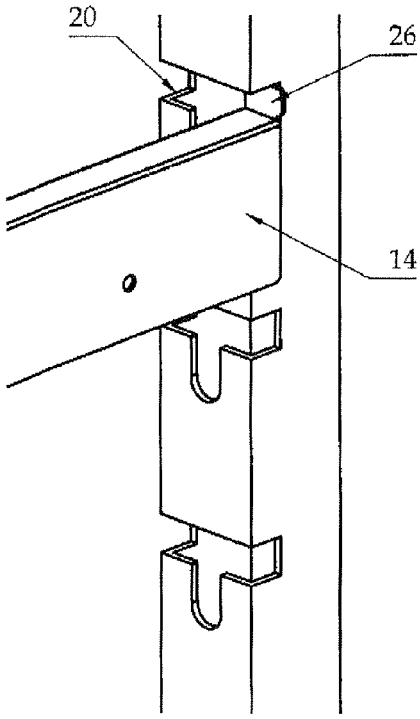

The exemplary embodiment shown in FIGS. 1 and 3 illustrates a rail 14 that is formed having a projection 26 that is formed by folding over the ends of the bottom of the U-shaped folded edge 25 and whose height corresponds to the width of the breakouts 20.

The design of the holes 18 and of the rails 14 permits the rails 14 to be introduced laterally and in a simple manner into the hole 18, the free leg 24 of the U-shaped folded edge 24, 25 being inserted along the vertically extending section of the T-shaped holes 18 into these and then the U-shaped folded edge 24, 25 being lowered while receiving the section 22. In this state, the rail 14 is secured against a movement to the front or to the rear, also in the direction of the longitudinal member 10, 12, but also in the transverse direction thereto, but can be moved upwards (for taking apart).

In the exemplary embodiment shown in FIGS. 1 and 3, the rail is provided with a projection 26 that is formed by folding over the bottom of the U-shaped folded edge 25, the height of the projection 26 corresponding to the width of the breakouts 20 (that is of the vertical section of the T-shaped holes 18). This enables the rail 14 to be introduced by moving the rail 14 in the direction towards the rear longitudinal member 12, after which the rail is inserted laterally with its end (not provided with a projection 26) into the hole 18 in the front longitudinal member 10. The projection 26 secures against a lifting of the rail 14, but the rail 14 can again be taken out by first lifting the front end, displaced relative to the front longitudinal rail 10, and then being pulled out.

Figure 4:
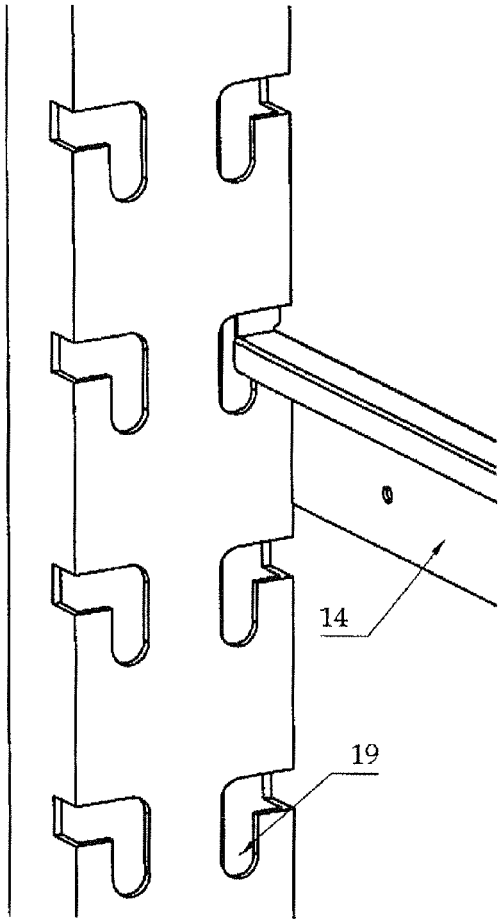
FIG. 4 shows an embodiment of a central longitudinal member and FIG. 5 shows an illustration corresponding to FIG. 4.
Figure 5:
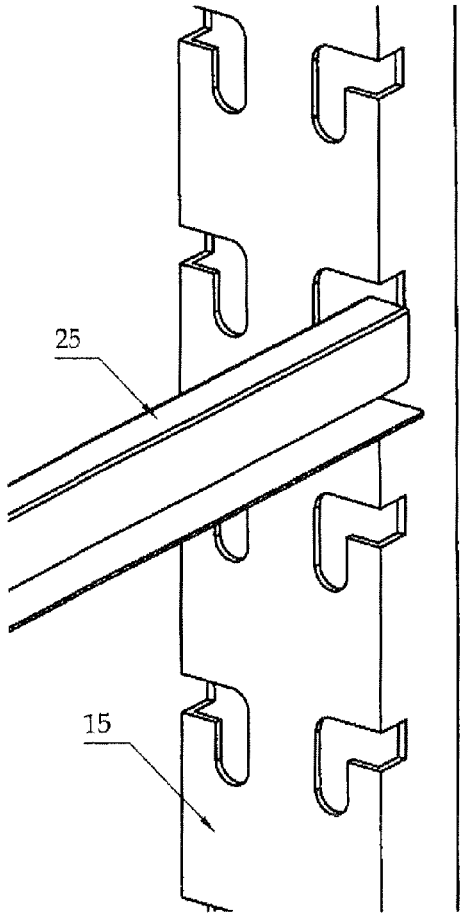

FIG. 4 shows the formation of one of the longitudinal members 12, as it is used in particular as a central longitudinal member, a longitudinal member having a larger width having to be used. Here the T-shaped holes 18 are formed by two angles whose vertically extending sections 19 run at a distance from each other.

The assembly kit proposed here facilitates simple assembly of the rack, the rails being inserted and secured in a simple manner without a tool having to be used.

The invention claimed is:

1. An assembly kit for building a rack, comprising:

a plurality of longitudinal members to be arranged vertically for interconnection to a plurality of cross members to be arranged horizontally, and a plurality of rails configured to accommodate rack bottoms or drawers, wherein:

the longitudinal members are provided with holes used to hook in the rails on first lateral surfaces of the longitudinal members facing each other, the holes in the longitudinal members define T-shaped holes in top view and include vertically extending sections leading to horizontally extending sections that form breakouts in second lateral surfaces of the longitudinal members, with the second lateral surfaces being adjacent to the first lateral surfaces, the rails are longer than an open distance between a front longitudinal member from a rear longitudinal member by a depth of the breakouts and are provided with U-shaped folded edges, each of the folded edges including a substantially horizontal portion extending from an upper portion of a respective rail and a substantially vertical portion extending downward from the substantially horizontal portion thereby defining an open width which corresponds to sections remaining in the first lateral surface on both sides of a respective one of the vertically extending sections of the T-shaped holes, and a width of the vertically extending section of the T-shaped hole corresponds to a length of the substantially vertical portion of the U-shaped folded edge.

2. The assembly kit according to claim 1, wherein at least one pair of rails is provided with projections that are formed by folding over ends of a bottom of the U-shaped folded edges, with each of the ends having a height which corresponds to a width of the breakouts.

3. The assembly kit according to claim 1, wherein in one of the longitudinal members the T-shaped hole is formed by two angles whose vertically extending sections extend at a distance from each other.

4. The assembly kit according to claim 2, wherein in one of the longitudinal members the T-shaped hole is formed by two angles whose vertically extending sections extend at a distance from each other.

5. A rack including comprising:

a plurality of longitudinal members arranged vertically and adapted to be interconnected by a plurality of horizontally arranged cross members, said plurality of longitudinal members including T-shaped holes, a first lateral surface and second lateral surfaces adjacent the first lateral surface, each of said T-shaped holes including a vertically extending section in the first lateral surface leading to a horizontally extending section that forms breakouts in the second lateral surfaces, and a plurality of rails configured to accommodate rack bottoms or drawers, each of said plurality of rails extending across and being hooked to a respective pair of said plurality of longitudinal members which face each other, while having a length which is longer, by a depth of the breakouts, than a distance between the first lateral surfaces of the pair of said plurality of longitudinal members, each of said plurality of rails being provided with U-shaped folded edges, each of the folded edges defining a free leg extending into the vertically extending section of one of the plurality of longitudinal members and having a width which corresponds to a distance between the vertically extending section of the one of the plurality of longitudinal members and a respective one of the second lateral surfaces.

6. The rack according to claim 5, wherein at least one pair of said plurality of rails is provided with projections formed by folding over ends of a bottom of the U-shaped folded edges, with each of the ends having a height which corresponds to a vertical dimension of the breakouts.

7. The rack according to claim 6, wherein, in at least one of the plurality of longitudinal members, the T-shaped hole is formed by two angles including vertically extending sections spaced along the first lateral surface.

8. The rack according to claim 5, wherein, in at least one of the plurality of longitudinal members, the T-shaped hole is formed by two angles including vertically extending sections spaced along the first lateral surface.

* * * * *